United States Patent [19]

Hall

[11] 3,991,920

[45] Nov. 16, 1976

[54] DEVICE FOR APPLYING STOCKING

[76] Inventor: Thomas D. Hall, 821 Hudson Road, Glenview, Ill. 60025

[22] Filed: Sept. 29, 1975

[21] Appl. No.: 617,869

[52] U.S. Cl. ..... 223/111
[51] Int. Cl.[2] ..... A47J 51/06
[58] Field of Search ..... 223/111, 1; 294/103

[56] References Cited

UNITED STATES PATENTS

| | | | |
|---|---|---|---|
| 358,128 | 2/1887 | Sanford | 223/111 |
| 916,508 | 3/1909 | Vietor | 223/111 |
| 1,591,354 | 7/1926 | Baillie | 294/103 R |
| 2,243,305 | 5/1941 | Adler | 294/103 R |
| 2,894,669 | 7/1959 | Silken | 223/111 |
| 2,903,170 | 9/1959 | Ahn | 223/111 |
| 2,917,338 | 12/1959 | Blue | 294/103 R |

*Primary Examiner*—George H. Krizmanich

[57] ABSTRACT

A device for applying a stocking to a foot comprises a pair of generally U-shaped clamping members through which the foot can be inserted. One of the clamping members is attached to an elongated rod and the other clamping member is attached to an elongated tube which telescopingly receives the rod. A rolled-up stocking is clamped between the clamping members, and the clamping pressure is controlled by a handle which is attached to the ends of the rod and tube. As the foot is inserted through the clamping members, the stocking unrolls onto the foot and leg.

1 Claim, 5 Drawing Figures

FIG. 1
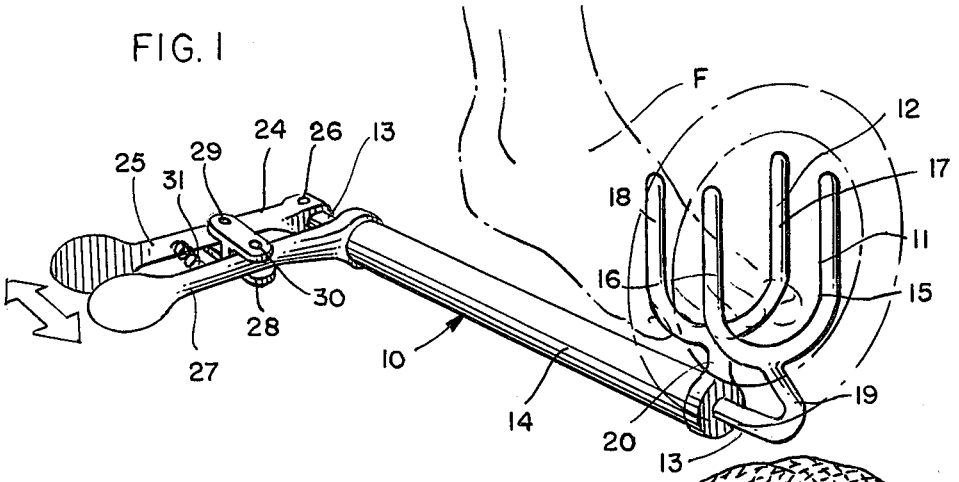
FIG. 2
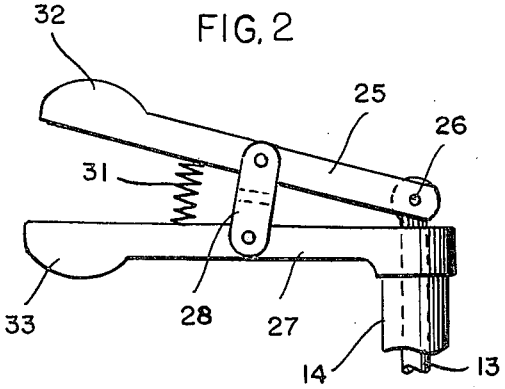
FIG. 3
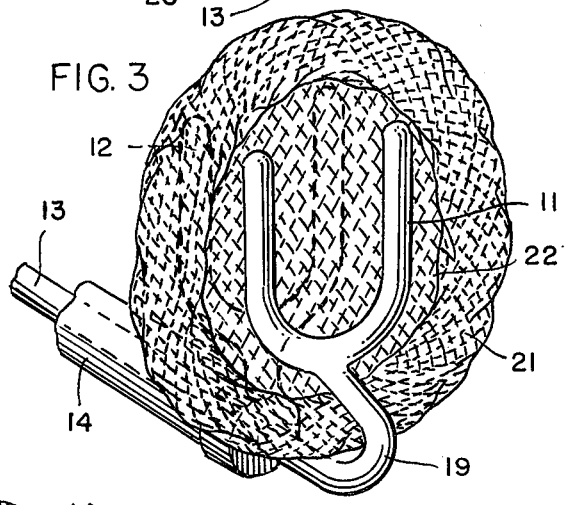
FIG. 4
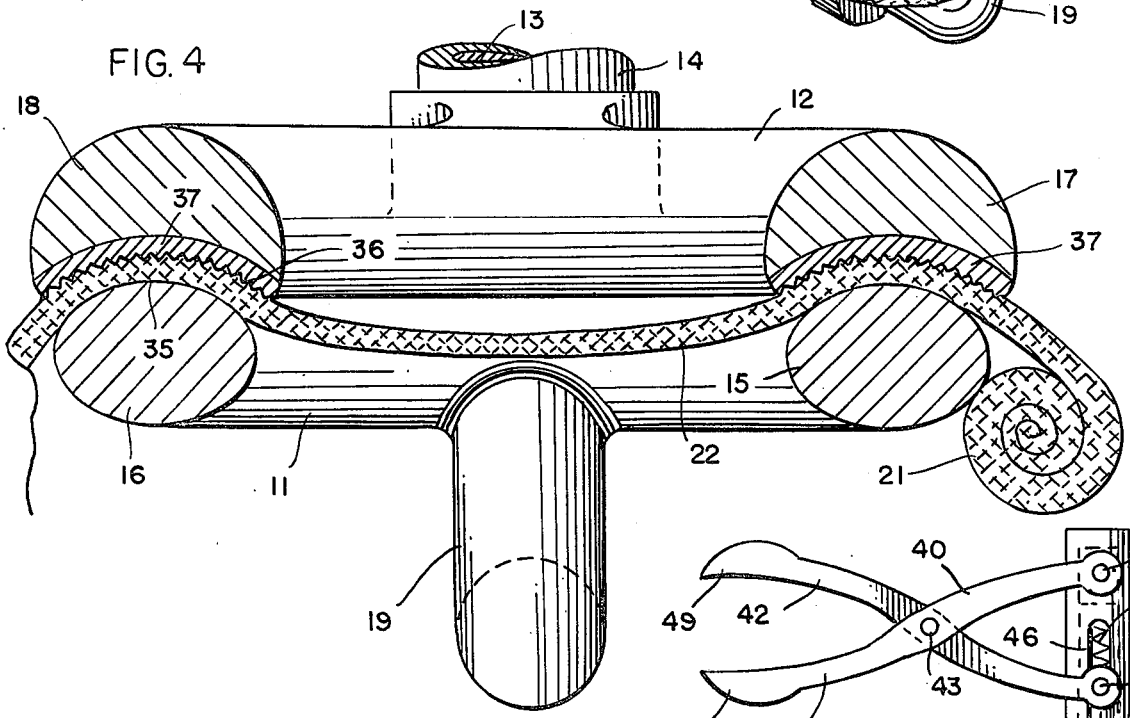
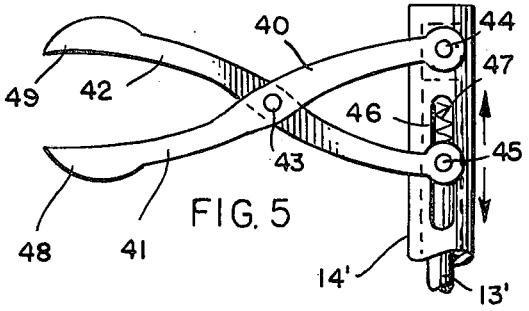
FIG. 5

DEVICE FOR APPLYING STOCKING

BACKGROUND AND SUMMARY

This invention relates to a device for applying a stocking, and, more particularly, to a device which permits a person to apply his own stocking without assistance.

In many instances orthopedic conditions resulting from disease or injury, with or without surgery, may result in a limitation of motion in one or more joints of the lower extremity. One of the most common complaints given by the patient to his physician is the inability to put on his own stocking or sock.

The application of the stocking to the foot is accomplished by placing the rolled stocking between a pair of U-shaped clamping members. One of the clamping members is attached to an elongated rod by a connecting portion, but the connecting portion is offset or curved downwardly to accommodate the rolled portion of the stocking. The other clamping member is attached to an elongated tube which telescopingly receives the rod, and telescoping movement of the rod within the tube controls the clamping pressure on the stocking and thereby controls the advancement of the stocking over the foot and leg as the foot is pushed into the stocking.

DESCRIPTION OF THE DRAWING

The invention will be explained in conjunction with an illustrative embodiment shown in the accompanying drawing, in which FIG. 1 is a perspective view of a stocking applier formed in accordance with the invention;

FIG. 2 is a fragmentary elevational view of one embodiment of a leverage type handle for controlling the telescoping movement of the rod and tube;

FIG. 3 is a fragmentary perspective view showing the rolled-up stocking positioned between the clamping members;

FIG. 4 is an enlarged fragmentary sectional view showing the stocking clamped between the clamping members; and FIG. 5 is a view similar to FIG. 2 showing another type of leverage type handle.

DESCRIPTION OF SPECIFIC EMBODIMENT

Referring first to FIG. 1, the numeral 10 designates generally a stocking applying device which includes a pair of generally U-shaped clamping members 11 and 12 which are secured, respectively, to an elongated rod 13 and an outer tube or housing 14.

The clamping member 11 includes a pair of side legs 15 and 16, and the clamping member 12 includes a pair of side legs 17 and 18. The distance between the side legs 15 and 16 and between the side legs 17 and 18 is sufficient to accommodate the width of a foot F of the user of the device.

Each of the clamping members 11 and 12 extends in a plane which is generally transverse to the longitudinal axes of the rod 13 and tube 14. The clamping member 11 is attached to the rod 13 by a connecting portion 19 which is offset or curved downwardly from the plane of the clamping member, and the clamping member 12 is attached to the tube 14 by a connecting portion 20 which extends generally transversely to the tube. The offset or curved connecting portion 19 is sized to accommodate the rolled-up periphery 21 of a rolled-up stocking 22 (FIG. 3) as will be explained more fully hereinafter.

A leverage type handle 24 is attached to the upper ends of the rod 13 and tube 14. The particular handle illustrated in FIG. 1 includes a lever arm 25 which is pivotally secured to the upper end of the rod 13 by a pin 26 and a lever arm 27 which is secured to the upper end of the tube 14. The lever arms are joined for relative pivotal movement by a bracket 28 which is secured to the arms 25 and 27 by pivot pins 29 and 30, respectively. A coil spring 31 is positioned between the outer portions of the lever arms outwardly of the bracket 28.

The spring 31 normally biases the lever arms 25 and 27 into the relative positions shown in FIG. 2. In this position the rod 13 is pushed downwardly within the tube 14 to separate the clamping members 11 and 12 as shown in FIG. 1. When the outer end portions or gripping portions 32 and 33 of the lever arms are squeezed together by the hand of the user, the rod 13 will telescope upwardly within the tube 14 and move the clamping member 11 toward the clamping member 12.

Referring now to FIGS. 3 and 4, a stocking 22 which will be applied with the device 10 is rolled up by rolling the upper end of the stocking downwardly along the outside of the stocking until the lower end or toe portion extends between the rolled-up periphery 21. The rolled-up stocking is placed over the lower clamping member 11 with the rolled-up periphery 21 positioned outwardly of the leg portions 15 and 16. The portion of the rolled-up periphery below the connecting portion 20 which attaches the upper clamping member to the tube 14 will be positioned in the curved connecting portion 19. The lower clamping member 11 is generally oval in cross section and provides a convex surface 35 which faces the upper clamping member 12. The upper clamping member 12 includes a concave surface 36 which faces the convex surface 35.

The spring 31 which biases the gripping portions 32 and 33 of the handle apart also normally maintains the clamping members in the separated positions shown in FIGS. 1 and 3. This permits the rolled-up stocking to be inserted between the clamping members. The gripping portions of the handle are then squeezed by the user to move the clamping member 11 toward the clamping member 12 and to apply a frictional gripping force on the stocking.

The user of the device applies the stocking by pushing his foot through the U-shaped clamping members so that the toe end of the stocking is drawn over the toes. As the foot is pushed through the clamping members, the stocking is drawn through the space between the confronting clamping members and the rolled-up periphery 21 unrolls. Controlled advancement of the stocking is provided by maintaining the proper gripping pressure on the handle so that the frictional force exerted on the stocking is not so great as to prevent advancement of the stocking over the lower clamping member 11 but is sufficient to provide smooth unrolling action. The U-shaped clamping members provide a uniform clamping action around the entire confronting surfaces, and the stocking will unroll evenly around its entire periphery.

The applying device permits the stocking to be inserted over the foot without stooping or bending, and as the foot is inserted through the clamping members, the handle can be drawn upwardly along the leg to advance the stocking over the ankle and leg of the user.

I have found it desirable to form the lower clamping member 11 with a smooth superior surface 35 and to make the lower clamping member of low friction material so that the stocking can advance easily over the lower clamping member. However, the confronting surface 36 of the upper clamping member is desirably formed of material which provides high friction yet a smooth surface. Such a surface can be provided by a strip 37 of felt, dimpled plastic or rubber, or the like. The outer ends of the legs of the two clamping members are advantageously rounded to prevent snagging of the stocking.

A modified handle 40 is shown in FIG. 5 and comprises a pair of plier type lever arms 41 and 42 whih are pivotally connected by a pin 43. The lever arm 42 is pivotally connected to the upper end of the tube 14' by a pin 44, and the lever arm 42 is pivotally connected to the upper end of the rod 13' by a pin 45, which extends through a slot 46 in the tube. The rod 13' is normally maintained in the position illustrated by a coil spring 47 which extends between the upper end of the rod and the upper end of the tube and which maintains the gripping portions 48 and 49 of the lever arms separated. When the rod is in the position illustrated, the lower clamping member 11 is spaced from the upper clamping member 12 as in FIG. 1. When the gripping portions 48 and 49 of the lever arms are squeezed together, the rod 13' is telescoped upwardly within the tube 14', and the clamping members are drawn together to provide the desired controlled frictional force on the stocking.

Although I have described the apparatus for use in applying stockings, the apparatus can also be used for removing a stocking. The upper end of a stocking which is being worn by the operator of the device can be clamped between the two clamping members. The clamping members can then be moved downwardly along the leg and foot, and the stocking will be turned inside out and pulled off of the leg and foot.

While in the foregoing specification a detailed description of a specific embodiment of the invention was set forth for the purpose of illustration, it is to be understood that many of the details hereingiven may be varied considerably by those skilled in the art without departing from the spirit and scope of the invention.

I claim:

1. An apparatus for applying a stocking to a foot comprising first and second generally arcuately shaped clamping members through which the foot can be inserted, an elongated support rod having upper and lower ends, the lower end being connected to the first clamping member, an elongated support tube having upper and lower ends telescopingly receiving the support rod, the lower end of the support tube being connected to the second clamping member whereby the clamping members can be moved toward or away from each other by telescoping movement of the support rod within the support tube, each of the arcuate clamping members extending in a plane generally transverse to the support rod and support tube, the first clamping member including a generally U-shaped connecting portion connected to the first clamping member and the second clamping member including a connecting portion connected to the support tube, the U-shaped connecting portion providing a space between the U-shaped connecting portion and the other connecting portion for accommodating a rolled-up stocking, the first clamping member having a generally convex smooth surface facing the second clamping member and the second clamping member having a generally concave surface facing the first clamping member and including friction-providing material for providing a frictional force on a stocking clamped between the two clamping members, a pair of pivotally connected handle levers secured to the upper ends of the support rod and support tube, pivotal movement of the handle levers causing telescoping movement of the support rod within the support tube whereby the frictional force on the stocking can be varied and controlled.

* * * * *